US009768555B2

(12) United States Patent
Farkas et al.

(10) Patent No.: US 9,768,555 B2
(45) Date of Patent: Sep. 19, 2017

(54) SYSTEMS AND METHODS FOR FREQUENCY SHIFTING RESONANCE OF CONNECTOR STUBS

(71) Applicant: Dell Products L.P., Round Rock, TX (US)

(72) Inventors: Sandor Farkas, Round Rock, TX (US); Bhyrav M. Mutnury, Round Rock, TX (US); Raymond Dewine Heistand, II, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 14/747,947

(22) Filed: Jun. 23, 2015

(65) Prior Publication Data

US 2016/0380396 A1 Dec. 29, 2016

(51) Int. Cl.
*H01R 13/60* (2006.01)
*H01R 13/646* (2011.01)
*H01R 13/03* (2006.01)

(52) U.S. Cl.
CPC ..... *H01R 13/646* (2013.01); *H01R 13/03* (2013.01)

(58) Field of Classification Search
CPC ..... H01R 13/20; H01R 13/6471
See application file for complete search history.

(56) References Cited

U.S. PATENT DOCUMENTS 4,260,212 A * 4/1981 Ritchie ..... H01R 4/2425 29/885
4,923,414 A 5/1990 Sitzler
6,439,931 B1 * 8/2002 Niitsu ..... H01R 23/6873 439/660
7,249,981 B2 7/2007 Chen
7,377,823 B2 5/2008 Chen
7,687,724 B2 * 3/2010 Das ..... H05K 1/167 174/260
8,172,614 B2 * 5/2012 Kirk ..... H01R 23/688 439/108
9,240,644 B2 * 1/2016 Cohen ..... H01R 13/20

FOREIGN PATENT DOCUMENTS

EP 0084318 A2 7/1983

* cited by examiner

*Primary Examiner* — Xuong Chung Trans
(74) *Attorney, Agent, or Firm* — Jackson Walker L.L.P.

(57) ABSTRACT

In accordance with embodiments of the present disclosure, a connector may include a housing and a pin housed in the housing and configured to electrically couple to a corresponding electrically-conductive conduit of an information handling resource comprising the connector. The pin may include an approximate connection point at which the pin electrically couples to a corresponding pin of another connector mated to the connector and a stub extending from the approximate connection point and constructed such that a per-unit-length signal propagation delay through the stub is significantly larger than a per-unit-length signal propagation delay through the remainder of the pin excluding the stub.

18 Claims, 7 Drawing Sheets

SYSTEMS AND METHODS FOR FREQUENCY SHIFTING RESONANCE OF CONNECTOR STUBS

TECHNICAL FIELD

The present disclosure relates in general to information handling systems, and more particularly to a system and method for frequency shifting resonance of an unused mating stub in a connector.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system may include one or more circuit boards operable to mechanically support and electrically couple electronic components making up the information handling system. For example, circuit boards may be used as part of motherboards, memories, storage devices, storage device controllers, peripherals, peripheral cards, network interface cards, and/or other electronic components. As is known in the art, a circuit board may comprise a plurality of conductive layers separated and supported by layers of insulating material laminated together, with conductive traces disposed on and/or in any of such conductive layers. As is also known in the art, connectivity between conductive traces disposed on and/or in various layers of a circuit board may be provided by conductive vias.

To electrically couple circuit boards together or to couple a circuit board to a cable comprising electrically conductive wires, electrical connectors may be used. One type of mating between connectors may be referred to as a mating blade architecture, depicted in FIGS. 1A and 1B. In a mating blade architecture, a first connector 10 may comprise a housing 12 (e.g., constructed of plastic or other suitable material) which houses one or more blade pins 14 electrically coupled via the connector to corresponding electrically-conductive conduits (e.g., wires of a cable or vias/traces of a circuit board). A second connector 16 of the mating blade architecture may include a housing 18 (e.g., constructed of plastic or other suitable material) which houses one or more beam pins 20. To couple first connector 10 and second connector 16, a force may be applied to one or both of first connector 10 and second connector 16 in the direction of the double-ended arrow shown in FIG. 1A, such that each blade pin 14 slides under the upwardly-curving portion of a corresponding beam pin 20, to electrically couple each blade pin 14 to its corresponding beam pin 20 at a contact point 22 as shown in FIG. 1B.

As a result of the coupling between a blade pin 14 and its corresponding beam pin 20, portions of each of blade pin 14 and beam pin 20 may be "unused" in the sense that such portions are present but not needed to conduct a signal between blade pin 14 and beam pin 20. Rather, such portions are present to create mechanical features ensuring the physical mating of connectors 10 and 16. For example, as can be seen from FIG. 1B, blade pin 14 may have an unused portion or "stub" 24 which is not part of an electrically conductive path between blade pin 14 and beam pin 20, and beam pin 20 may also have an unused portion or stub 26 which is not part of an electrically conductive path between blade pin 14 and beam pin 20.

Each stub 24 and 26 may act as an antenna, and thus may resonate at frequencies (and harmonics thereof) for which the length of such stub 24 or 26 is equal to one-quarter of the wavelength of such frequencies. As transmission frequencies used in the communication pathways of information handling systems increase, signals operating at such frequencies may be affected by such resonances, resulting in decreased signal integrity.

Some approaches may be employed to mitigate the effect of stub resonances, but such approaches still have disadvantages. For example, an alternative to the mating blade architecture, and known as a mating beam architecture, is depicted in FIGS. 2A and 2B. In a mating beam architecture, a first connector 30 may comprise a housing 32 (e.g., constructed of plastic or other suitable material) which houses one or more first beam pins 34 electrically coupled via the connector to corresponding electrically-conductive conduits (e.g., wires of a cable or vias/traces of a circuit board). A second connector 36 of the mating blade architecture may include a housing 38 (e.g., constructed of plastic or other suitable material) which houses one or more second beam pins 40. To couple first connector 30 and second connector 36, a force may be applied to one or both of first connector 30 and second connector 36 in the direction of the double-ended arrow shown in FIG. 2A, such that each first beam pin 34 slides under the upwardly-curving portion of a corresponding second beam pin 40, to electrically couple each first beam pin 34 to its corresponding beam pin 40 at a contact point 42 as shown in FIG. 2B. While this architecture may eliminate the mating blade stub of one connector, this architecture still includes two stubs 44 and 46 which may cause undesirable resonances.

SUMMARY

In accordance with the teachings of the present disclosure, the disadvantages and problems associated with resonance in connector stubs have been reduced or eliminated.

In accordance with embodiments of the present disclosure, a connector may include a housing and a pin housed in the housing and configured to electrically couple to a corresponding electrically-conductive conduit of an information handling resource comprising the connector. The pin may include an approximate connection point at which the pin electrically couples to a corresponding pin of another connector mated to the connector and a stub extending from the approximate connection point and constructed such that a per-unit-length signal propagation delay through the stub is significantly larger than a per-unit-length signal propagation delay through the remainder of the pin excluding the stub.

In accordance with these and other embodiments of the present disclosure, an information handling system may include an information handling resource and a connector coupled to the information handling resource, the connector comprising a housing and a pin housed in the housing and configured to electrically couple to a corresponding electrically-conductive conduit of the information handling resource. The pin may include an approximate connection point at which the pin electrically couples to a corresponding pin of another connector mated to the connector and a stub extending from the approximate connection point and constructed such that a per-unit-length signal propagation delay through the stub is significantly larger than a per-unit-length signal propagation delay through the remainder of the pin excluding the stub.

In accordance with these and other embodiments of the present disclosure, a method may include, for a pin having an approximate connection point at which the pin electrically couples to a corresponding pin and a stub extending from the approximate connection point, constructing the stub such that a per-unit-length signal propagation delay through the stub is significantly larger than a per-unit-length signal propagation delay through the remainder of the pin excluding the stub.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
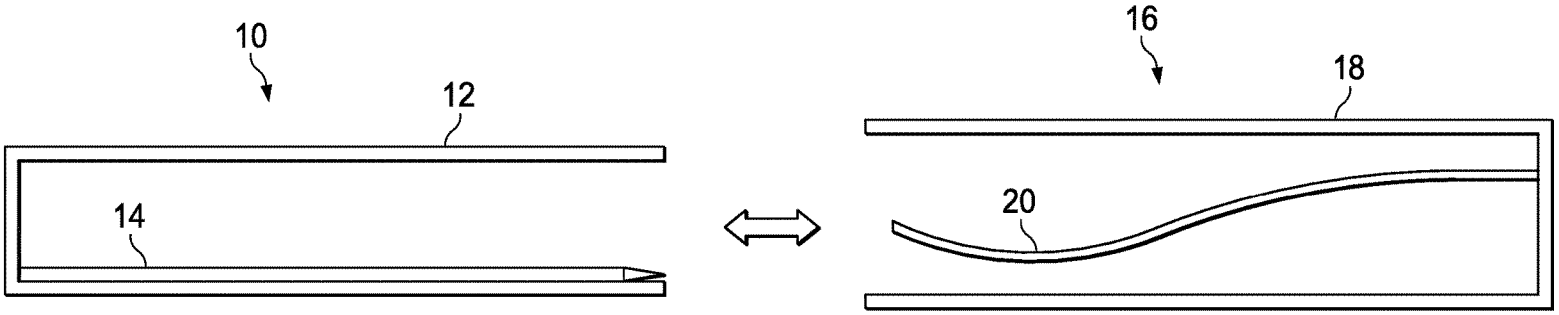
FIG. 1A (PRIOR ART)
FIGS. 1A and 1B each illustrate a cross-sectional elevation view of selected components of connectors for use in a mating blade architecture, as is known in the art.

Preferred embodiments and their advantages are best understood by reference to FIGS. 3A through 6, wherein like numbers are used to indicate like and corresponding parts.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/or flash memory; as well as communications media such as wires, optical fibers, microwaves, radio waves, and other electromagnetic and/or optical carriers; and/or any combination of the foregoing.

For the purposes of this disclosure, information handling resources may broadly refer to any component system, device or apparatus of an information handling system, including without limitation processors, service processors, basic input/output systems, buses, memories, I/O devices and/or interfaces, storage resources, network interfaces, motherboards, and/or any other components and/or elements of an information handling system.

As discussed above, an information handling system may include one or more circuit boards operable to mechanically support and electrically connect electronic components making up the information handling system (e.g., packaged integrated circuits). Circuit boards may be used as part of motherboards, memories, storage devices, storage device controllers, peripherals, peripheral cards, network interface cards, and/or other electronic components. As used herein, the term "circuit board" includes printed circuit boards (PCBs), printed wiring boards (PWBs), etched wiring boards, and/or any other board or similar physical structure operable to mechanically support and electrically couple electronic components.

Figure 3A:
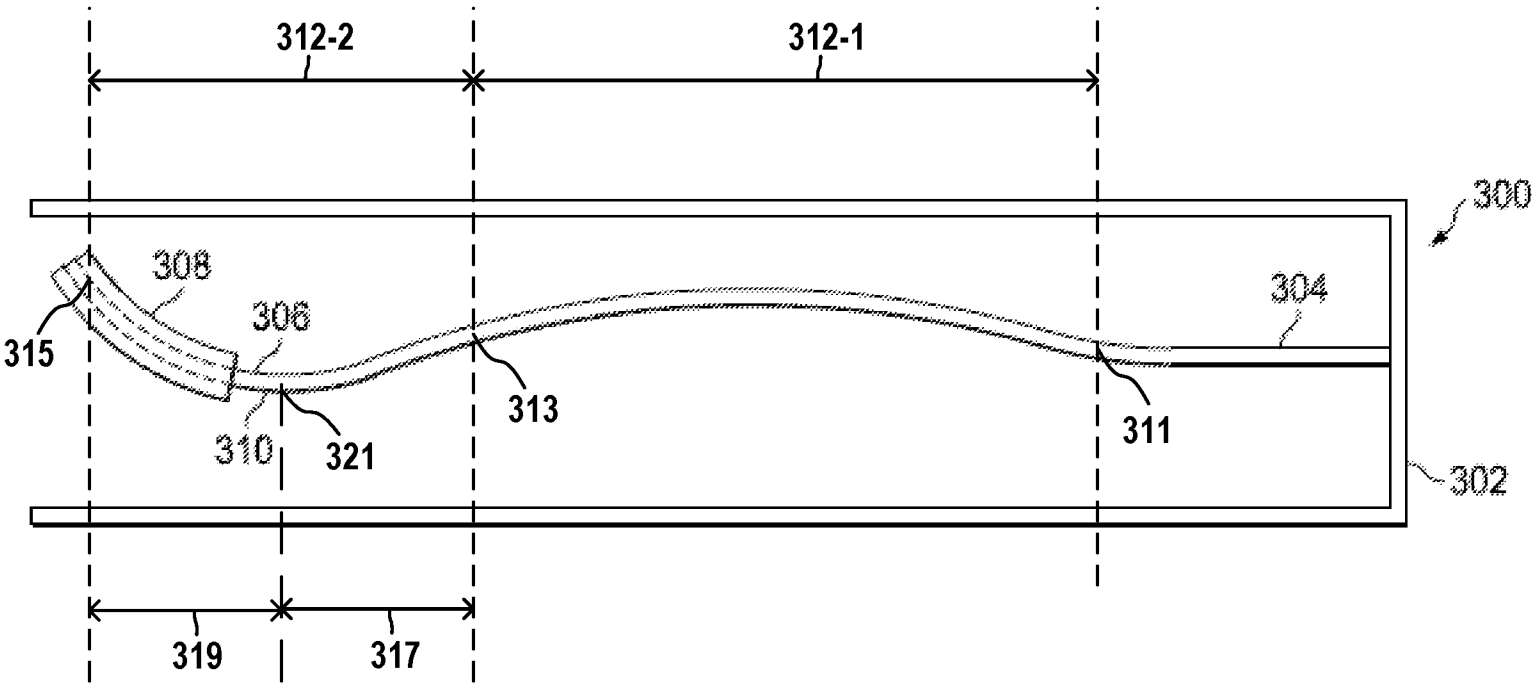
FIG. 3A illustrates a cross-sectional elevation view of selected components of a beam-type connector, in accordance with embodiments of the present disclosure.
Figure 3B:
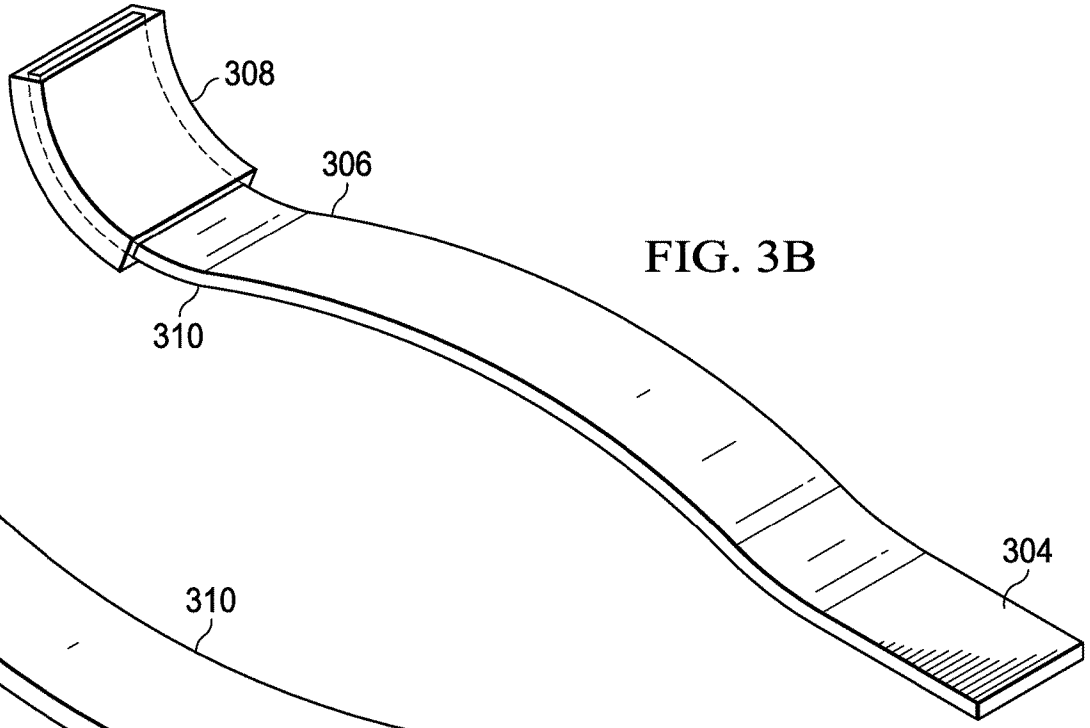
FIGS. 3B and 3C each illustrate an isometric view of a pin of the beam-type connector depicted in FIG. 3A, in accordance with embodiments of the present disclosure.
Figure 3C:
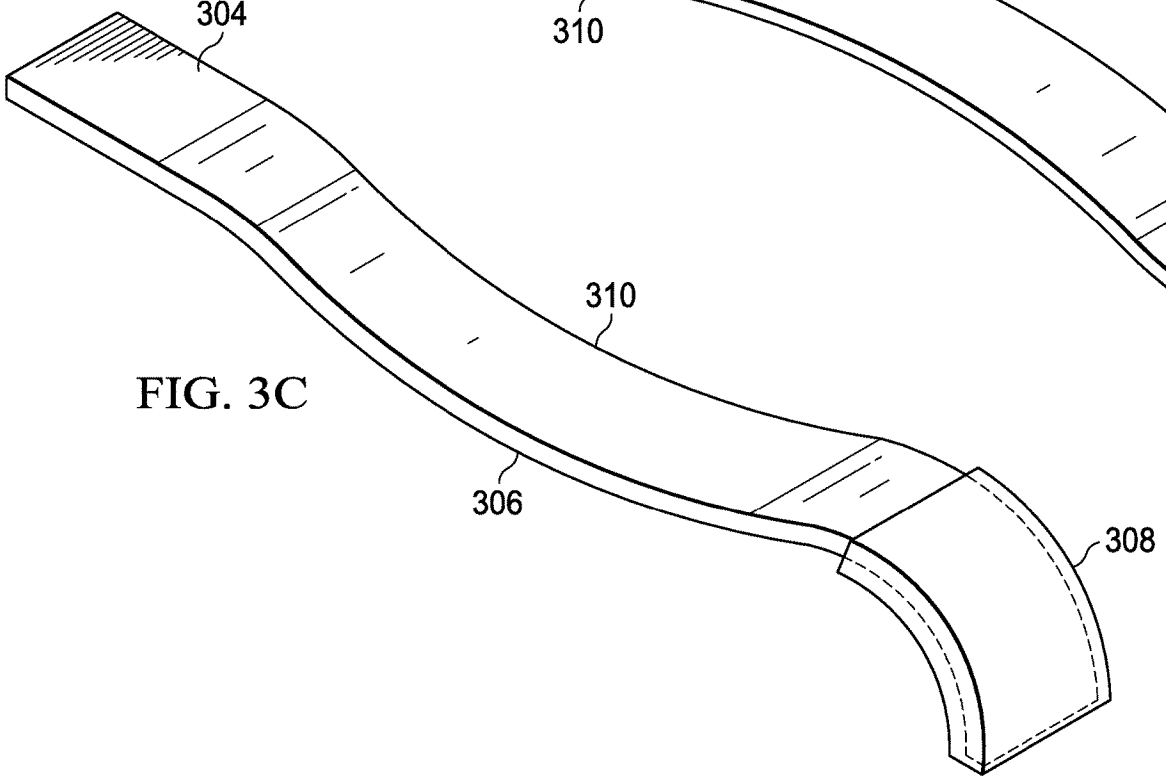

FIG. 3A illustrates a cross-sectional elevation view of selected components of a beam-type connector 300, and FIGS. 3B and 3C each show an isometric view of a beam pin 304 for use in beam-type connector 300, in accordance with embodiments of the present disclosure. As shown in FIG. 3A, connector 300 may comprise a housing 302 (e.g., constructed of plastic or other suitable material) which houses one or more beam pins 304 electrically coupled via the connector to corresponding electrically-conductive conduits (e.g., wires of a cable or vias/traces of a circuit board).

The beam pin 304 illustrated in FIG. 3A includes two curved portions of opposite concavity, namely, a first curved portion 312-1, extending between a proximal point 311 of beam pin 304 and a medial point 313 of the pin, and a second curved portion 312-2, extending between the medial point 313 of beam pin 304 and a distal point 315 of beam pin 304. The first curved portion 312-1 illustrated in FIG. 3A has a downward concavity while the second curved portion 312-2 has an upward concavity. Second curved portion 312-2 of the beam pin 304 illustrated in FIG. 3A includes a positively sloped portion 317 and a negatively sloped portion 319. Positively sloped portion 317 comprises a portion of second curved portion 312-2 extending between medial point 313 and a local minimum point 321 of second curved portion 312-2. The negatively sloped portion 319 comprising a portion of second curved portion 312-2 extending between local minimum point 321 and distal point 315.

Local minimum points 321 of beam pin 304 may correspond to an approximate electrical contact point 310 at which such beam pin 304 may physically come in contact with a corresponding pin of another connector when mated with such other connector. Extending away from its approximate electrical contact point 310, a beam pin 304 may include a stub 306 corresponding to the negatively sloped portion 319. Stub 316 may have a shape or other physical features to facilitate mechanical mating of connector 300 to another connector and adequate electrical contact between beam pins 304 and corresponding pins of the other connector. As shown in FIGS. 3A-3C, beam pin 304 may comprise a coating 308 around stub 306, wherein such coating has a significantly higher dielectric constant (e.g., 4 to 10) than the conductive material (e.g., aluminum, copper, silver, gold, or other metal) making up beam pin 304. Example materials of coating 308 may include plastic, paint, polyamide, or other materials having a dielectric constant significantly greater than that of electrically-conductive metals.

The existence of such coating 308 may serve to render the per-unit-length signal propagation delay through stub 306, i.e., negatively sloped portion 319, to be significantly larger than the per-unit-length signal propagation delay through the remainder of beam pin 304, i.e, the portion of beam pin 304 comprising first curved portion 312-1 and the positively sloped portion 317 of second curved portion 312-2. Accordingly, a resonant quarter wavelength of stub 306 comprising coating 308 may occur at significantly higher frequencies compared to a stub 306 not having such coating 308. In some embodiments, the resonance properties of stub 306 may be controlled by constructing coating 308 having physical properties (e.g., material, shape, thickness, etc.) to provide for resonance at a particular frequency.

Figure 4A:
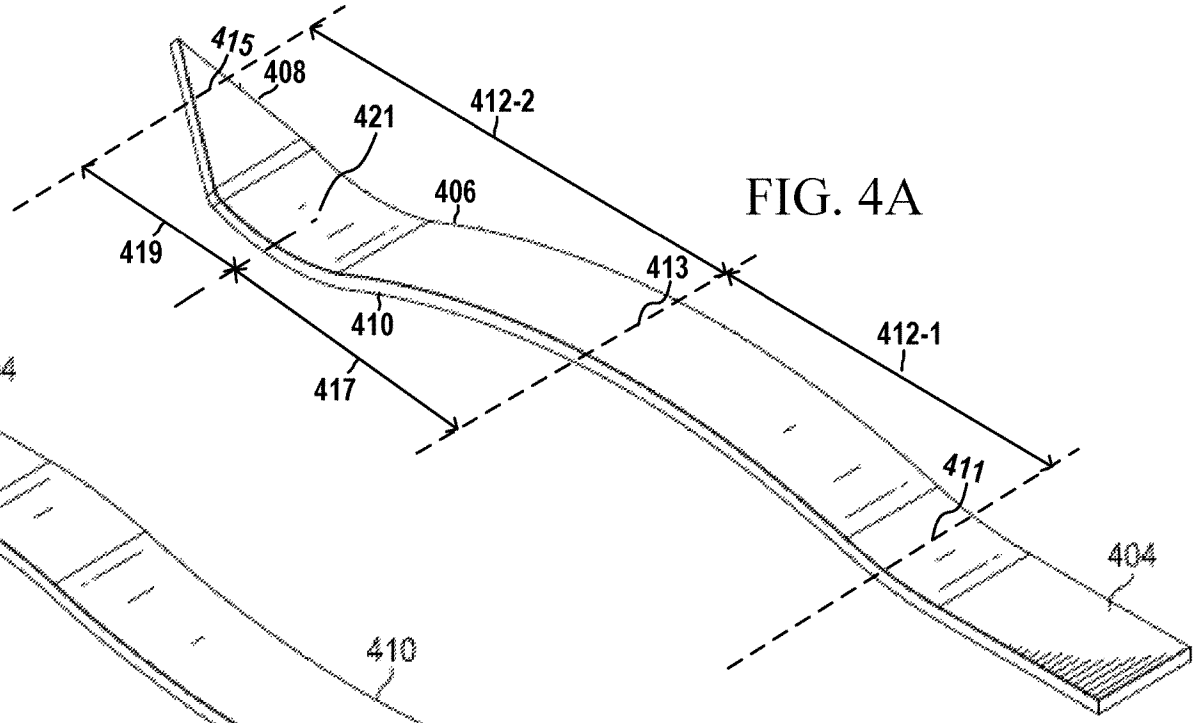
FIGS. 4A and 4B each illustrates an isometric view view of selected components of another beam-type connector, in accordance with embodiments of the present disclosure.
Figure 4B:
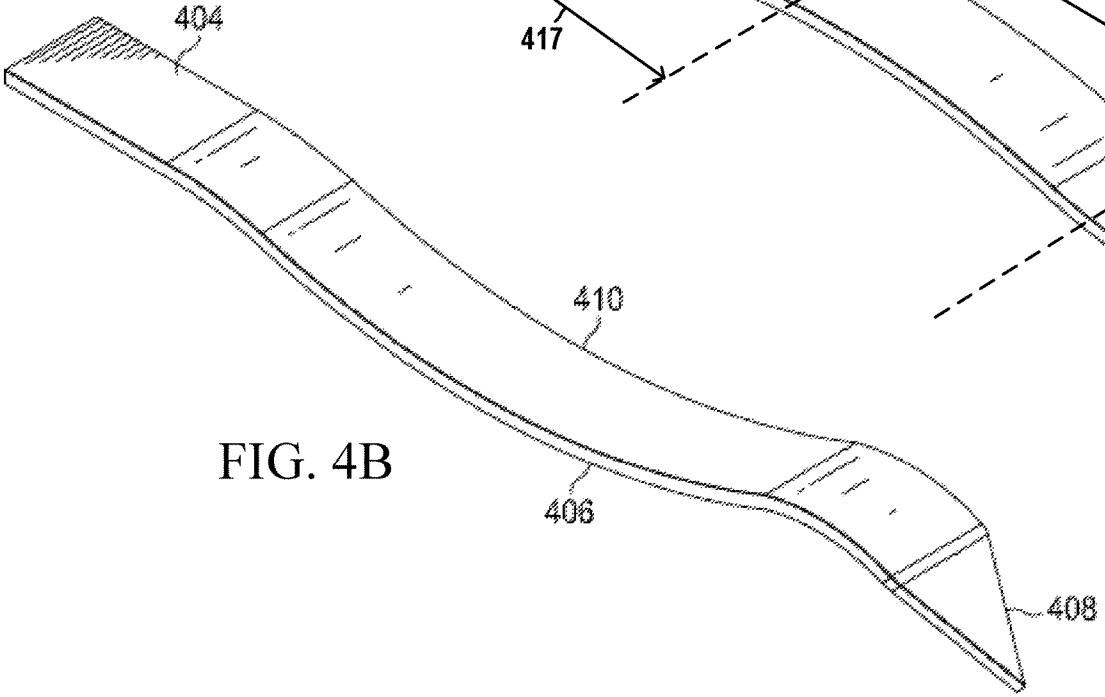

FIGS. 4A and 4B illustrate an isometric view of a beam pin 404 which may be used in beam-type connector similar to that shown in FIG. 3A, in accordance with embodiments of the present disclosure. Beam pin 404 may comprise one of a plurality of beam, pins 404 housed in a connector including a housing similar to that shown in FIG. 3A. Each beam pin 404 may have an approximate electrical contact point 410 at which such beam pin 404 may physically come in contact with a corresponding pin of another connector when mated with such other connector. Extending away from its approximate electrical contact point 410, a beam pin 404 may include a stub 406 which may have a shape or other physical features to facilitate mechanical mating of connector 400 to another connector and adequate electrical contact between beam pins 404 and corresponding pins of the other connector.

Analogous to the beam pin 304 of FIG. 3A, the beam pin 404 illustrated in FIG. 4A includes two curved portions of opposite concavity, namely, a first curved portion 412-1, extending between a proximal point 411 of beam pin 404 and a medial point 413 of the pin, and a second curved portion 412-2, extending between the medial point 413 of beam pin 404 and a distal point 415 of beam pin 404. The first curved portion 412-1 illustrated in FIG. 4A has a downward concavity while the second curved portion 412-2 has an upward concavity. Second curved portion 412-2 of the beam pin 404 illustrated in FIG. 3A includes a positively sloped portion 417 and a negatively sloped portion 419. Positively sloped portion 417 comprises a portion of second curved portion 412-2 extending between medial point 413 and a local minimum point 421 of second curved portion 412-2. The negatively sloped portion 419 comprising a portion of second curved portion 412-2 extending between local minimum point 421 and distal point 415.

As shown in FIG. 4A, stub 406 may include a tapering feature 408 that tapers (e.g., decreases in thickness) from approximate electrical contact point 410 to an end 412 of beam pin 404, or between a point between approximate electrical contact point 410 and end 412 to end 412.

The existence of such taper 408 may serve to render the per-unit-length signal propagation delay through stub 406, i.e., negatively sloped portion 419, to be significantly larger than the per-unit-length signal propagation delay through the remainder of beam pin 404, i.e, the portion of beam pin 404 comprising first curved portion 412-1 and the positively sloped portion 417 of second curved portion 412-2. Accordingly, a resonant quarter wavelength of stub 406 comprising taper 408 may occur at significantly higher frequencies compared to a stub 406 not having such taper 408 (e.g., a stub 406 not decreasing in thickness in a direction towards its end). In some embodiments, the resonance properties of stub 406 may be controlled by constructing taper 408 having physical properties (e.g., length of taper 408, degree of taper along the length of taper 408, etc.) to provide for resonance at a particular frequency.

Figure 5A:
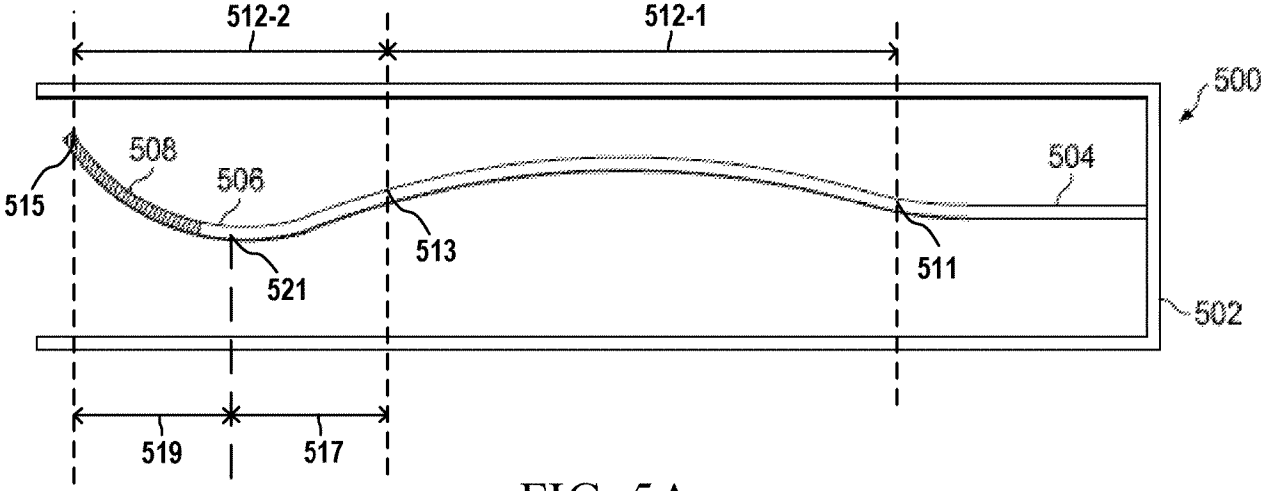
FIG. 5A illustrates a cross-sectional elevation view of selected components of another beam-type connector, in accordance with embodiments of the present disclosure.
Figure 5B:
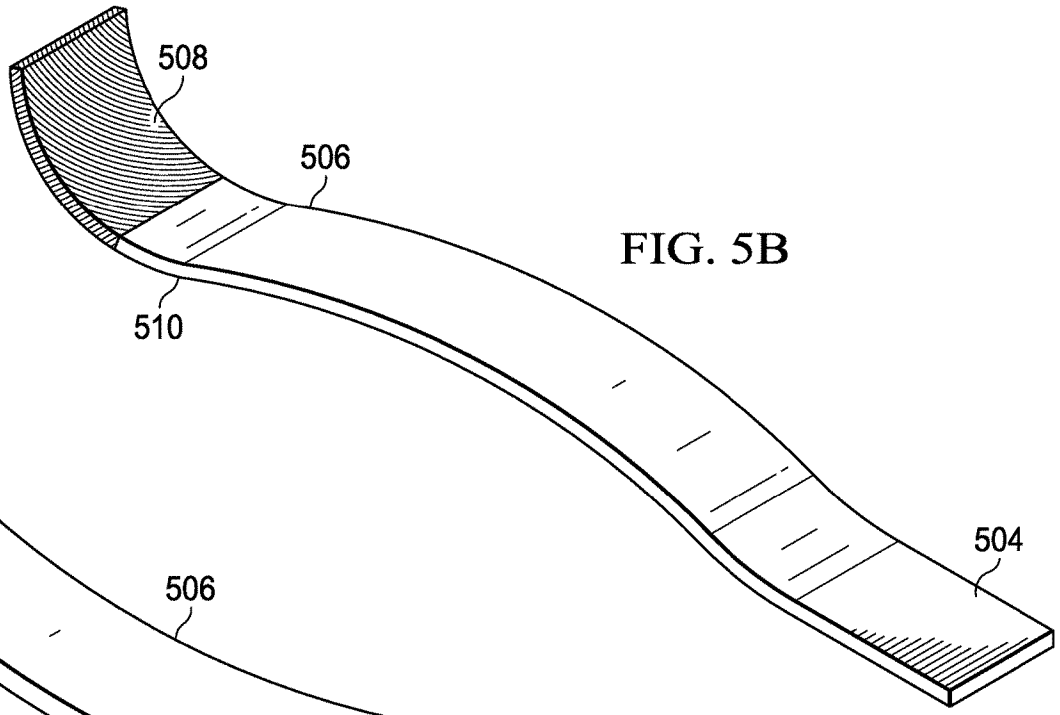
FIGS. 5B and 5C each illustrate an isometric view of a pin of the beam-type connector depicted in FIG. 5A, in accordance with embodiments of the present disclosure.
Figure 5C:
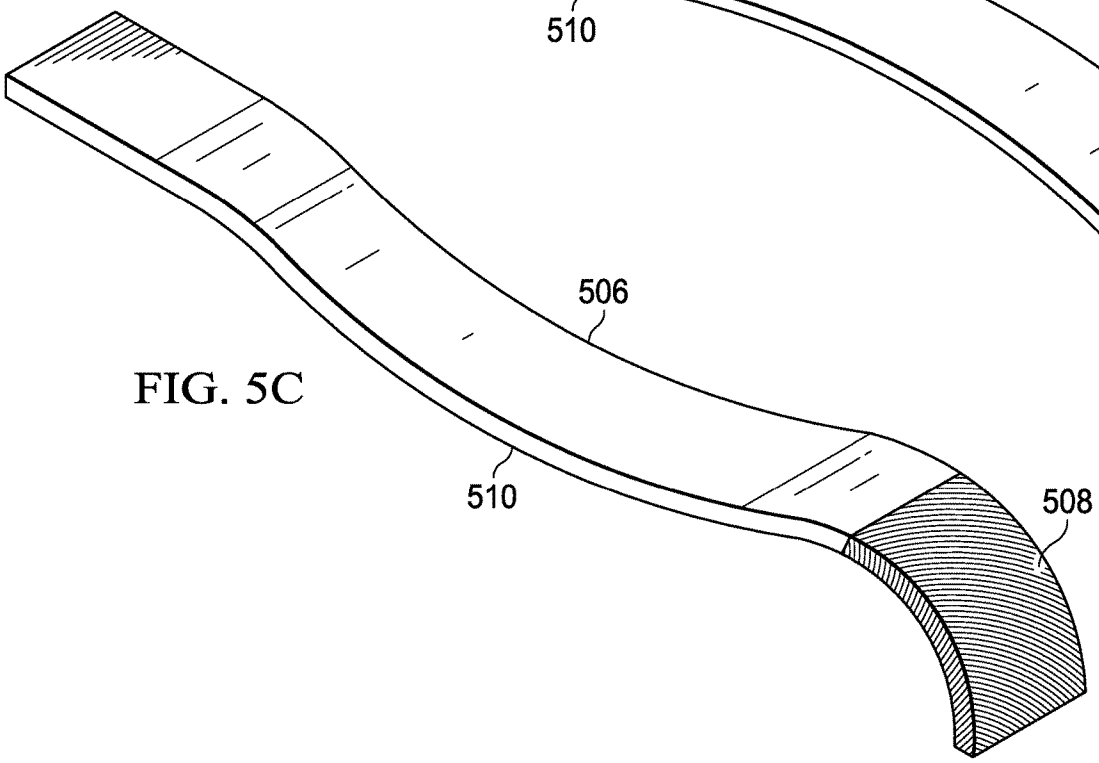

FIG. 5A illustrates a cross-sectional elevation view of selected components of a beam-type connector 500, and FIGS. 5B and 5C each show an isometric view of a beam pin 504 for use in beam-type connector 500, in accordance with embodiments of the present disclosure. As shown in FIG. 5A, connector 500 may comprise a housing 502 (e.g., constructed of plastic or other suitable material) which houses one or more beam pins 504 electrically coupled via the connector to corresponding electrically-conductive conduits (e.g., wires of a cable or vias/traces of a circuit board). Each beam pin 504 may have an approximate electrical contact point 510 at which such beam pin 504 may physically come in contact with a corresponding pin of another connector when mated with such other connector. Extending away from its approximate electrical contact point 510, a beam pin 504 may include a stub 506 which may have a shape or other physical features to facilitate mechanical mating of connector 500 to another connector and adequate electrical contact between beam pins 504 and corresponding pins of the other connector.

Analogous to beam pin 304 of FIG. 3A and beam pin 404 of FIG. 4A, the beam pin 504 illustrated in FIG. 5A includes two curved portions of opposite concavity, namely, a first curved portion 512-1, extending between a proximal point 511 of beam pin 504 and a medial point 513 of the pin, and a second curved portion 512-2, extending between the medial point 513 of beam pin 504 and a distal point 515 of beam pin 504. The first curved portion 512-1 illustrated in FIG. 5A has a downward concavity while the second curved portion 512-2 has an upward concavity. Second curved portion 512-2 of the beam pin 504 illustrated in FIG. 3A includes a positively sloped portion 517 and a negatively sloped portion 519. Positively sloped portion 517 comprises a portion of second curved portion 512-2 extending between medial point 513 and a local minimum point 521 of second curved portion 512-2. The negatively sloped portion 519 comprising a portion of second curved portion 512-2 extending between local minimum point 521 and distal point 515.

As shown in FIGS. 5A-5C, stub 506 may include one or more coarsening features 508. Coarsening features 508 may include any features created on stub 506 via any process to coarsen, roughen, abrade, grind, scratch, scrape, or etch (e.g., mechanically or chemically) the material of stub 506.

The existence of such coarsening features 508 may serve to render the per-unit-length signal propagation delay through stub 506, i.e., negatively sloped portion 519, to be significantly larger than the per-unit-length signal propagation delay through the remainder of beam pin 504, i.e, the portion of beam pin 404 comprising first curved portion 412-1 and the positively sloped portion 417 of second curved portion 412-2. Accordingly, a resonant quarter wavelength of stub 506 comprising coarsening features 508 may occur at significantly higher frequencies compared to a stub 506 not having such coarsening features. In some embodiments, the resonance properties of stub 506 may be controlled by constructing coarsening features 508 having physical properties (e.g., type of features, degree of coarsening, etc.) to provide for resonance at a particular frequency.

In general, in all three of connectors 300, 400, and 500, each connector includes a pin having an approximate connection point to a corresponding pin of a second connector, and the pin having a stub extending from the approximate connection point, wherein the stub is constructed such that the per-unit-length signal propagation delay through the stub is significantly larger than the per-unit-length signal propagation delay through the remainder of the pin excluding the stub. Thus, connectors may still provide mechanical rigidity and tolerance as compared to existing approaches, while increasing resonance frequencies as compared to existing approaches.

Figure 1B:
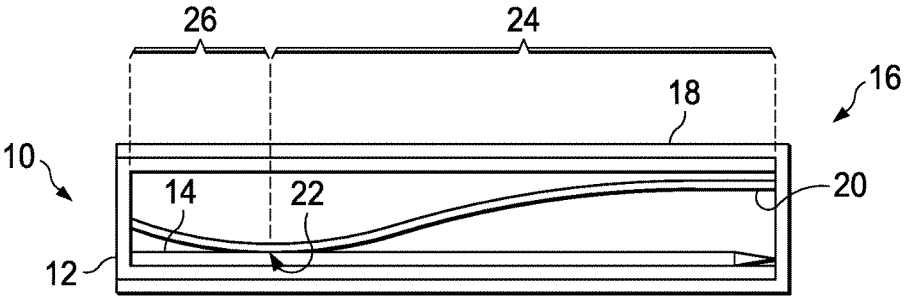
FIG. 1B (PRIOR ART)
Figure 2A:
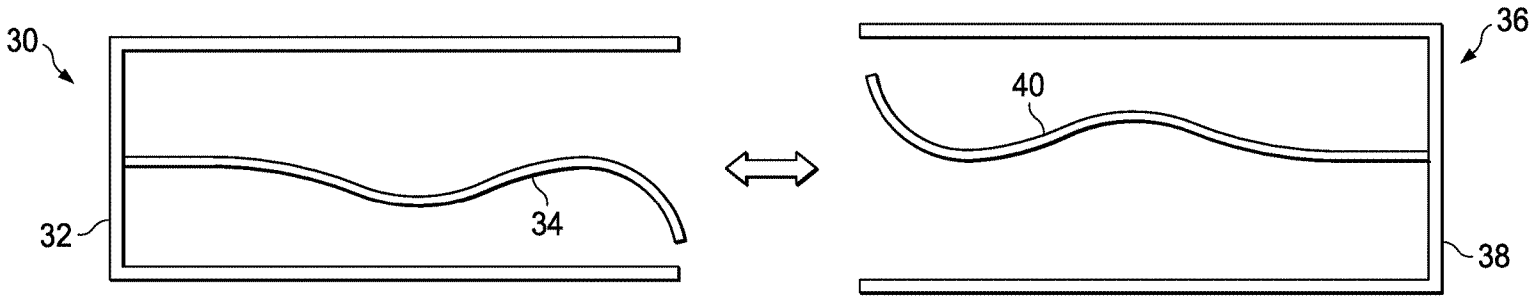
FIG. 2A (PRIOR ART)
FIGS. 2A and 2B each illustrate a cross-sectional elevation view of selected components of connectors for use in a mating beam architecture, as is known in the art.
Figure 2B:
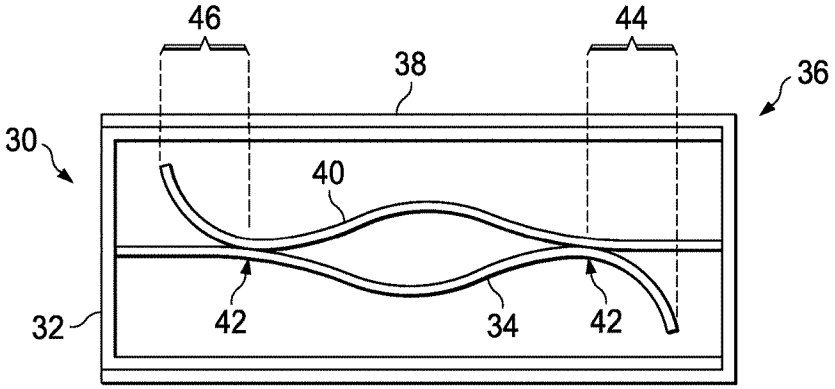
FIG. 2B (PRIOR ART)
Figure 6A:
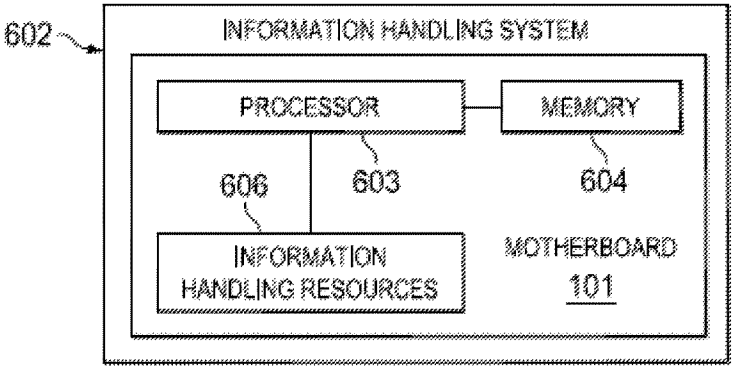
FIG. 6 illustrates a block diagram of an example information handling system, in accordance with certain embodiments of the present disclosure.

FIG. 6 illustrates a block diagram of an example information handling system 602, in accordance with certain embodiments of the present disclosure. As depicted in FIG. 1, information handling system 602 may include a motherboard 601 having a processor 603, a memory 604, and information handling resources 606 coupled thereto.

Motherboard 601 may include a circuit board configured to provide structural support for one or more information handling resources of information handling system 602 and/or electrically couple one or more of such information handling resources to each other and/or to other electric or electronic components external to information handling system 602. In some embodiments, motherboard 601 may comprise a circuit board having one or more connectors such as those connectors disclosed herein.

Processor 603 may be mounted to motherboard 601 and may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 603 may interpret and/or execute program instructions and/or process data stored in memory 604 and/or another information handling resource of information handling system 602.

Memory 604 may be communicatively coupled to processor 603 via motherboard 601 and may include any system, device, or apparatus configured to retain program instructions and/or data for a period of time (e.g., computer-readable media). Memory 604 may include RAM, EEPROM, a PCMCIA card, flash memory, magnetic storage, opto-magnetic storage, or any suitable selection and/or array of volatile or nonvolatile memory that retains data after power to information handling system 602 is turned off. In some embodiments, memory 604 may comprise one or more memory modules implemented using a circuit board having one or more connectors such as those connectors disclosed herein.

Information handling resources 606 may comprise any component systems, devices or apparatuses of information handling system 602, including without limitation processors, buses, memories, I/O devices and/or interfaces, storage resources, network interfaces, motherboards, integrated circuit packages; electro-mechanical devices, displays, and power supplies. In some embodiments, one or more information handling resources 606 may comprise one or more circuit boards having one or more connectors such as those connectors disclosed herein.

In addition, various information handling resources of information handling system 602 may be coupled via cables or other electronic conduits having one or more connectors such as those connectors disclosed herein As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

What is claimed is:

1. A connector comprising:

a housing;

a pin housed in the housing and configured to electrically couple to a corresponding electrically-conductive conduit of an information handling resource comprising the connector, the pin comprising:

a first curved portion between a proximal point of the pin and a medial point of the pin, wherein the first curved portion has a downward concavity and a first per-unit-length signal propagation delay;

a second curved portion between the medial point of the pin and a distal point of the pin, wherein the second curved portion has an upward concavity and wherein the second curved portion comprises:

a positively sloped portion having the first per-unit-length signal propagation delay, the positively sloped portion comprising a portion of the second curved portion between the medial point and a local minimum point of the second curved portion; and a negatively sloped portion having a second per-unit-length signal propagation delay, significantly greater than the first per-unit-length signal propagation delay, the negatively sloped portion comprising a portion of the second curved portion between the local minimum point and the distal point.

2. The connector of claim 1, wherein the pin includes a coating around at least a portion the negatively sloped portion of the second curved portion and no coating around remaining portions of the pin, including the local minimum point, wherein the coating has a significantly higher dielectric constant than a conductive material of which the pin is comprised.

3. The connector of claim 2, wherein the coating comprises polyamide.

4. The connector of claim 2, wherein the coating has physical properties selected to provide for resonance of the negatively sloped portion of the second curved portion at a particular frequency wherein the particular frequency is significantly higher than a frequency of a signal conveyed by the pin.

5. The connector of claim 1, wherein a thickness of the negatively sloped portion of the second curved portion decreases monotonically from a first thickness at the local minimum point to the terminal point.

6. The connector of claim 1, wherein the negatively sloped portion of the second curved portion comprises one or more coarsening features.

7. An information handling system comprising:

an information handling resource; and a connector coupled to the information handling resource and comprising:

a housing;

a pin housed in the housing and configured to electrically couple to a corresponding electrically-conductive conduit of the information handling resource, the pin comprising:

a planar portion between a first end of the pin and a proximal point of the pin;

a first curved portion between the proximal point and a medial point of the pin, wherein the first curved portion has a downward concavity and a first per-unit-length signal propagation delay;

a second curved portion between the medial point of the pin and a distal point of the pin, wherein the second curved portion has an upward concavity and wherein the second curved portion comprises:

a positively sloped portion having the first per-unit-length signal propagation delay, the positively sloped portion comprising a portion of the second curved portion between the medial point and a local minimum point of the second curved portion; and a negatively sloped portion having a second per-unit-length signal propagation delay, significantly greater than the first per-unit-length signal propagation delay, the negatively sloped portion comprising a portion of the second curved portion between the local minimum point and the distal point.

8. The information handling system of claim 7, wherein the pin includes a coating around at least a portion of the negatively sloped portion of the second curved portion and no coating around remaining portions of the pin, including the local minimum point, wherein the coating has a significantly higher dielectric constant than a conductive material of which the pin is comprised.

9. The information handling system of claim 8, wherein the coating comprises polyamide.

10. The information handling system of claim 8, wherein the coating has physical properties selected to provide for resonance of the negatively sloped portion of the second curved portion at a particular frequency.

11. The information handling system of claim 7, wherein a thickness of the negatively sloped portion of the second curved portion decreases monotonically from a first thickness at the local minimum point to the terminal point.

12. The information handling system of claim 7, wherein the negatively sloped portion of the second curved portion comprises one or more coarsening features.

13. A method, comprising:

constructing a pin having:

a planar portion between a first end of the pin an a proximal point of the pin;

a first curved portion between the proximal point of the pin and a medial point of the pin, wherein the first curved portion has a downward concavity and a first per-unit-length signal propagation delay; and a second curved portion between the medial point of the pin and a distal point of the pin, wherein the second curved portion has an upward concavity and wherein the second curved portion comprises:

a positively sloped portion having the first per-unit-length signal propagation delay, the positively sloped portion comprising a portion of the second curved portion between the medial point and a local minimum point of the second curved portion; and a negatively sloped portion having a second per-unit-length signal propagation delay, significantly greater than the first per-unit-length signal propagation delay, the negatively sloped portion comprising a portion of the second curved portion between the local minimum point and the distal point.

14. The method of claim 13, wherein constructing the pin comprises applying a coating around a portion of the negatively sloped portion of the second curved portion, wherein the coating has a significantly higher dielectric constant than a conductive material of which the pin is comprised and wherein the portion coated excludes the local minimum point.

15. The method of claim 14, wherein the coating comprises one of plastic and polyamide.

16. The method of claim 14, further comprising selecting physical properties of the coating to provide for resonance of the negatively sloped portion of the second curved portion at a particular frequency.

17. The method of claim 13, wherein constructing the pin comprises forming a taper of decreasing thickness between the local minimum point and distal point.

18. The method of claim 13, wherein constructing the pin comprises forming one or more coarsening features on the negatively sloped portion of the second curved portion.

* * * * *